United States Patent [19]

Musschoot

[11] 4,454,906

[45] Jun. 19, 1984

[54] VIBRATORY METHOD FOR PACKING FOUNDRY SAND INTO A PATTERN PRIOR TO THE POURING OF MOLTEN METAL

[75] Inventor: Albert Musschoot, Barrington, Ill.

[73] Assignee: General Kinematics Corporation, Barrington, Ill.

[21] Appl. No.: 428,286

[22] Filed: Sep. 29, 1982

Related U.S. Application Data

[63] Continuation-in-part of Ser. No. 212,988, Dec. 4, 1980, abandoned.

[51] Int. Cl.[3] ..... B22C 7/02; B22C 15/10

[52] U.S. Cl. ..... 164/34; 164/39

[58] Field of Search ..... 164/39, 34, 35

[56] References Cited

U.S. PATENT DOCUMENTS 3,678,989 7/1972 Krzyzanowski ..... 164/34 X

*Primary Examiner*—Kuang Y. Lin

*Attorney, Agent, or Firm*—Wood, Dalton, Phillips, Mason & Rowe

[57] ABSTRACT

The invention relates to the casting of molten metal where a pattern embedded in sand is used to determine the shape into which the molten metal is formed. To ensure that the foundry sand fully penetrates all cavities and recesses of the pattern, the mold flask containing the pattern and sand is first vibrated at a frequency and stroke to produce accelerations in excess of the acceleration due to gravity to cause the sand to penetrate and completely fill all cavities, etc. in the pattern and then the accelerations are reduced to produce an acceleration less than the acceleration due to gravity to compact the sand in place.

5 Claims, 5 Drawing Figures

VIBRATORY METHOD FOR PACKING FOUNDRY SAND INTO A PATTERN PRIOR TO THE POURING OF MOLTEN METAL

DESCRIPTION

This is a continuation-in-part of application Ser. No. 212,988, filed Dec. 4, 1980, now abondoned, to Albert Musschoot and entitled "Vibratory Method For Packing Foundry Sand Into a Pattern Prior to the Pouring of Molten Metal".

BACKGROUND OF THE INVENTION

Metal casting operations have long employed the combination of a pattern set in a mold flask and with foundry sand compacted therearound to form the desired shape. In the normal operation, the pattern is then withdrawn from the sand and molten metal poured in the place previously occupied by the pattern which causes the metal to assume the shape of the pattern.

More recently, a modified system is employed wherein the pattern is made of a material which is converted to gas when contacted by the molten metal. With such patterns, it is not necessary to remove the pattern prior to casting and the result has been the ability to utilize more complicated patterns, i.e., patterns with more complex configurations such as internal passages, cavities, and the like.

In an effort to cause the foundry sand to fill cavities and the like in patterns, a system has been used wherein air is introduced into the bottom of the mold flask and flows upwardly through the sand with the intent being that the force of the moving air will in effect blow the sand into the cavities. While this method is effective for relatively simple patterns, it has not been completely effective where the pattern contains a number of internal passages, cavities, and the like.

SUMMARY OF THE INVENTION

In accordance with the present invention, the sand is caused to fill all cavities, internal passages, etc. in a pattern by utilizing a method wherein the mold flask containing the foundry sand and pattern is subjected to vibrations at a frequency and stroke which will impart to the sand accelerations greater than the acceleration due to gravity. The result of the vibrations is to cause the sand to "fluidize", i.e., act like a fluid, and thoroughly penetrate even very small passages in the pattern. After vibrating the mold flask containing the pattern and sand for a period sufficient to ensure that the sand has filled all openings in the pattern, the vibrations are reduced in force so as to impart an acceleration to the sand somewhat less than the acceleration due to gravity. The second stage of vibration effectively compacts the sand in place, thus making certain that the sand will remain in place when the molten metal is poured into the mold flask.

DESCRIPTION OF THE PREFERRED EMBODIMENT

Figure 1:
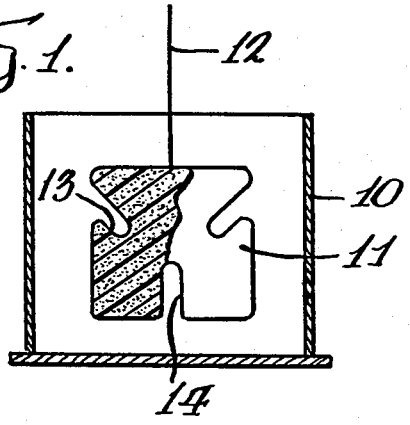
FIG. 1 is a vertical sectional view showing a mold flask with a pattern suspended therein.
Figure 2:
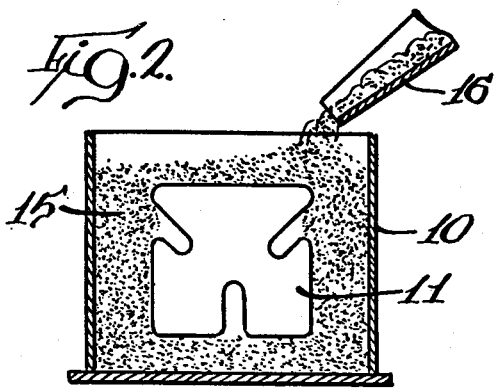
FIG. 2 is a view like FIG. 1 illustrating the introduction of foundry sand into the mold flask.
Figure 3:
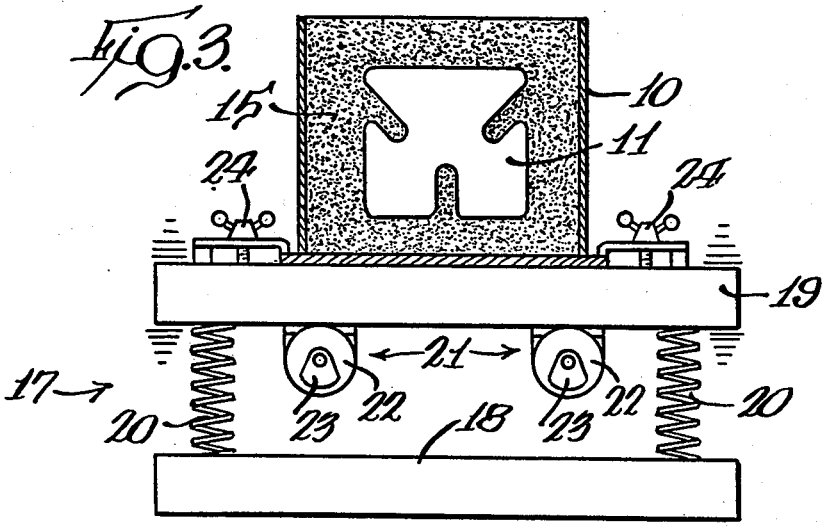
FIG. 3 is a side elevational view (partly in section) showing the mold flask, pattern and sand fixed in position on a vibratory apparatus.

The drawings described above illustrate the steps of the precess which is the subject matter of this invention. Thus there is shown a mold flask 10 with a pattern 11 suspended therein by suspension means 12. While the pattern may be of any conventional material, the process of the present invention is particularly useful when dealing with complex patterns which, by their very complexity, cannot be removed from the mold box and sand prior to pouring the molten metal. Rather, these complex patterns are made of material which gasifies when contacted by the molten metal, such as polyurethane foam and Styrofoam.

The complexities of the pattern 11 are schematically illustrated by the cavities 13 and the passage 14 which may be a dead-end passage in the pattern.

With the pattern suspended in place as shown in FIG. 1, sand is introduced by means of a conveyor 16 to fill the mold flask completely. The filled mold flask is then placed upon a vibratory apparatus 17 which includes a base 18, and a bed 19 suspended above the base by springs 20. Vibration generators 21 in the form of electric motors 22 having shafts carrying eccentric weights 23 are suspended from the bottom of the bed 19 in order to produce the vibrations. Preferably, the vibration generators 21 are of the type shown in my U.S. Pat. No. 3,358,815, where the effective force of the eccentric weights may be varied from zero to maximum and thus produce a variation in stroke as desired.

The mold flask 10 either is clamped to the bed 19 by clamps 24 or is positioned in an unclamped state on the bed 19. The vibration generators are then energized to produce a vibratory force on the mold flask and its contents in excess of the acceleration due to gravity. The acceleration in g's can be calculated by the formula $$S \times F^2/70400$$

where S is the amplitude of the stroke and F is the frequency of the stroke. For example, with a frequency of 3600 strokes per minute and a stroke amplitude of 0.007 inches, there is produced an acceleration of 1.29 g's on the mold box and its contents. This acceleration causes the sand to flow into and completely fill the cavities 13 and passage 14 even though those passages may be dead-ended. If the pattern contains even finer passages, the result is still to fill those passages completely. After a few minutes of vibration at accelerations in excess of gravity, the stroke of the vibratory apparatus is reduced thereby to reduce the accelerations to a force less than the acceleration due to gravity. Thus, maintaining the frequency at 3600 cycles per minute and reducing the amplitude of the stroke to 0.0045 inches, reduces the force to 0.92 g's. The effect of the acceleration at less than one g for several minutes is to compact the sand in place allowing it to retain its position when the molten metal is introduced into the mold flask.

Figure 4:
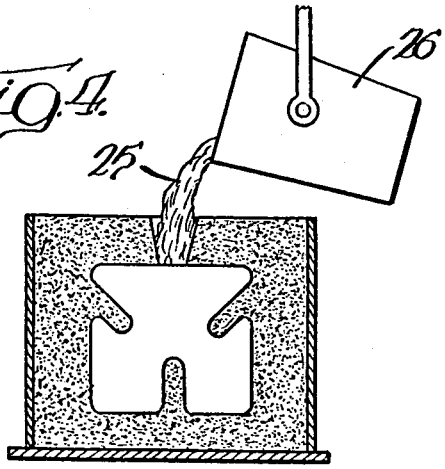
FIG. 4 is a vertical sectional view illustrating the operation of pouring molten metal into the mold flask.
Figure 5:
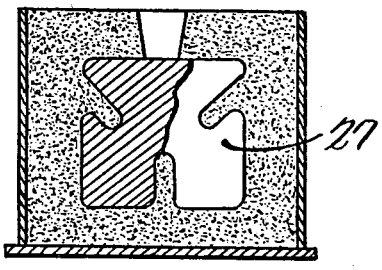
FIG. 5 is a vertical sectional view showing the resulting metal cast into the shape of the pattern.

In FIG. 4, I have illustrated the introduction of molten metal into the flask, the molten metal being given access to the pattern by a short passage, and the effect of contact of the molten metal with the foam pattern causes the latter to gassify, i.e., be converted into gas which escapes and the metal takes on the form of the pattern. The metal then is allowed to cool and, as illustrated in FIG. 5, completely fills the space previously occupied by the foam pattern and is formed with a true reproduction of all the cavities and passages that were formerly in the pattern.

The process of the present invention is particularly useful in the aluminum casting of engine cylinder blocks. By virtue of the process of this invention, the patterns for the cylinder blocks can be formed with coolant passages and other cavities and passages, and the result of the casting process produces an engine cylinder block having formed therein the configuration just mentioned.

I claim:

1. In a casting process the method which comprises introducing foundry sand into a mold flask containing a pattern, then subjecting the mold flask to vibratory movement at a frequency and stroke to produce accelerations on the mold flask and contents thereof in excess of the acceleration due to gravity to cause the sand to fill all openings in the pattern, and then subjecting the mold flask to vibratory movement at a frequency and stroke to produce accelerations on the mold flask and contents thereof less than the acceleration due to gravity to pack the sand in place.

2. In a casting process the method which comprises introducing foundry sand into a mold flask containing a pattern, then subjecting the mold flask to substantially vertical vibratory movement at a frequency and stroke to produce accelerations on the mold flask and contents thereof in excess of the acceleration due to gravity to cause the sand to fill all openings in the pattern, and then subjecting the mold flask to substantially vertical vibratory movement at a frequency and stroke to produce accelerations on the mold flask and contents thereof less than the acceleration due to gravity to pack the sand in place.

3. In a casting process wherein a material which substantially entirely vaporizes when contacted with molten metal is used as a pattern, the method which comprises introducing foundry sand into a mold flask containing the pattern, subjecting the mold flask to vibratory movement at a frequency and stroke to produce accelerations on the mold flask and contents thereof in excess of the acceleration due to gravity to cause the sand to fill all openings in the pattern, and then subjecting the mold flask to substantially vertical vibratory movement at a frequency and stroke to produce accelerations on the mold flask and contents thereof less than the acceleration due to gravity to pack the sand in place.

4. In a casting process wherein a material which substantially entirely vaporizes when contacted with molten metal is used as a pattern, the method which comprises introducing foundry sand into a mold flask containing the pattern, subjecting the mold flask to substantially vertical vibratory movement at a frequency and stroke to produce accelerations on the mold flask and contents thereof in excess of the acceleration due to gravity to cause the sand to fill all openings in the pattern, and then subjecting the mold flask to substantially vertical vibratory movement at a frequency and stroke to produce accelerations on the mold flask and contents thereof less than the acceleration due to gravity to pack the sand in place.

5. In a casting process wherein a material which substantially entirely vaporizes when contacted with molten metal is used as a pattern, the method which comprises introducing foundry sand into a mold flask containing the pattern, subjecting the mold flask to substantially vertical vibratory movement at a frequency of the order of 3600 cycles per minute and a stroke having an amplitude of the order of 0.007 inches to produce accelerations on the mold flask and contents thereof in excess of the acceleration due to gravity to cause the sand to fill all openings in the pattern, and then subjecting the mold flask to substantially vertical vibratory movement at a frequency of the order of 3600 cycles per minute and a stroke having an amplitude of the order of 0.0045 inches to produce accelerations on the mold flask and contents thereof less than the acceleration due to gravity to pack the sand in place.

* * * * *